US005853570A

United States Patent [19]

Hatanaka et al.

[11] Patent Number: 5,853,570

[45] Date of Patent: Dec. 29, 1998

[54] PROCESS FOR DESULFURIZING CATALYTICALLY CRACKED GASOLINE

[75] Inventors: Shigeto Hatanaka, Kanagawa; Osamu Sadakane; Satoru Hikita, both of Tokyo; Tadao Miyama, Kanagawa, all of Japan

[73] Assignee: Mitsubishi Oil Co., Ltd., Tokyo, Japan

[21] Appl. No.: 701,957

[22] Filed: Aug. 23, 1996

[30] Foreign Application Priority Data

Aug. 25, 1995 [JP] Japan ..... 7-239025

[51] Int. Cl.[6] ..... C10G 45/60

[52] U.S. Cl. ..... 208/216 PP; 208/217; 208/216 R; 208/243; 208/244; 208/58; 208/97

[58] Field of Search ..... 208/58, 97, 216 PP, 208/216 R, 243, 244

[56] References Cited

U.S. PATENT DOCUMENTS

| | | | |
|---|---|---|---|
| 3,291,721 | 12/1966 | Schuman | 208/97 |
| 3,472,759 | 10/1969 | Masologites et al. | 208/97 |
| 3,475,323 | 10/1969 | Stuckey et al. | 208/97 |
| 3,825,485 | 7/1974 | Coons, Jr. | 208/97 |
| 5,011,593 | 4/1991 | Ware et al. | 208/97 |
| 5,300,214 | 4/1994 | Creighton et al. | 208/216 PP |
| 5,340,466 | 8/1994 | Dai et al. | 208/216 PP |
| 5,358,628 | 10/1994 | Apelian | 208/58 |
| 5,397,456 | 3/1995 | Dai et al. | 208/216 PP |
| 5,460,713 | 10/1995 | Takito et al. | 208/216 PP |
| 5,514,273 | 5/1996 | Sherwood, Jr. et al. | 208/216 PP |

OTHER PUBLICATIONS

Monte et al, The Structural Form of Cobalt and Nickel Promoters in Oxidic HDS Catalysts, pp. 564 and 574.

*Primary Examiner*—Helane Myers
*Attorney, Agent, or Firm*—Sughrue, Mion, Zinn, Macpeak & Seas, PLLC

[57] ABSTRACT

A catalytically cracked gasoline feedstock is desulfurized under reaction conditions of a hydrogen feed rate measured at the reactor inlet of from 1 to 5 mols per mol of the feedstock oil and of from 5 to 50 mols per mol of the olefin components contained in the feedstock oil, a reaction temperature of from 200° to 300° C., a total pressure inside the reactor of from 10 to 20 kg/cm$^2$G, and a liquid hourly space velocity of from 2 to 8 l/hr, and using a catalyst which comprises a support mainly comprising alumina and having a surface area of 200 m$^2$/g or larger, wherein $MoO_3$ in an amount of from 10 to 20 wt % and CoO in an amount of from 3 to 6 wt % in terms of inner content are fixed to the support, and the weight ratio of $MoO_3$ to CoO is from 2.5 to 4.5.

4 Claims, No Drawings

PROCESS FOR DESULFURIZING CATALYTICALLY CRACKED GASOLINE

FIELD OF THE INVENTION

The present invention relates to a process for desulfurizing a catalytically cracked gasoline. More particularly, this invention relates to a process for catalytically hydrodesulfurizing a catalytically cracked gasoline containing sulfur compounds and olefin components. In the inventive process, not only is there a small decrease in the octane number of the gasoline because the hydrogenation of olefins is inhibited, but also high catalytic activity can be maintained over a long period of time.

BACKGROUND OF THE INVENTION

Among the products produced in the field of petroleum refining is a catalytically cracked gasoline. This product serves as an ingredient for high-octane gasolines containing a large amount of olefin components. The catalytically cracked gasoline is a gasoline fraction having a boiling point range of from about 20° to 250° C. and is obtained by catalytically cracking a heavy petroleum fraction feedstock, e.g., a vacuum gas oil or a topping residue, and recovering and distilling the catalytically cracked product. This product is used as a major blending ingredient for automotive gasolines.

However, the feedstock that is fed to a catalytic cracking apparatus originally contains a relatively large amount of sulfur compounds. If this untreated feedstock is catalytically cracked, the resulting catalytically cracked gasoline necessarily has a high sulfur compound content. Since the use of this cracked product as a blending ingredient for automotive gasolines may adversely influence the environment, the feedstock may be desulfurized prior to cracking. The catalytically cracked gasolines produced from desulfurized feedstocks contain sulfur compounds in an amount of from 30 to 300 ppm by weight (of the whole fraction), while those produced from untreated feedstocks contain sulfur compounds in an amount of from 50 to several thousands of ppm by weight (of the whole fraction). With such catalytically cracked gasolines, it is becoming difficult to comply with the recent strict regulations for environmental protection.

A hydrodesulfurization process conventionally employed in the field of petroleum refining is generally used to desulfurize feedstock oils prior to cracking. In this process, the feedstock to be desulfurized is contacted with an appropriate hydrodesulfurization catalyst in a high-temperature hydrogen atmosphere under pressure.

In the hydrodesulfurization of feedstocks that are to be catalytically cracked, such as, e.g., vacuum gas oils and topping residues, a hydrodesulfurization catalyst is used which is obtained by fixing Groups VIII and VI elements, e.g., chromium, molybdenum, tungsten, cobalt, nickel, etc., to an appropriate support, e.g., alumina. The hydrodesulfurization is generally carried out at a temperature of from about 250° to 350° C., a partial hydrogen pressure of from 30 to 200 kg/cm$^2$G, and a liquid hourly space velocity (LHSV) of from about 0.1 to 10 l/hr.

However, when undesulfurized feedstocks or inadequately desulfurized feedstocks are fed to a catalytic cracking apparatus, the resulting catalytically cracked gasolines must be directly hydrodesulfurized. Ordinary naphthas are desulfurized at a temperature of from about 250° to 350° C., a total reactor pressure of about 30 kg/cm$^2$G, a hydrogen/oil ratio of about 500 scf/bbl, and a liquid hourly space velocity (LHSV) of from about 3 to 5 l/hr. These conditions for the hydrodesulfurization of a catalytically cracked gasoline, however, are disadvantageous in that the olefin components contained in the gasoline in an amount of from about 10 to 50 vol % are hydrogenated. The reduced olefin content in turn results in a reduced octane number. There is another problem in that olefin components polymerize on the catalyst surface to yield a coke, which in turn reduces the catalytic activity.

Similar to desulfurization catalysts for feedstocks other than naphthas, catalysts for the desulfurization of naphthas are obtained by fixing Groups VIII and VI elements, e.g., chromium, molybdenum, tungsten, cobalt, nickel, etc., onto an appropriate support, e.g., alumina. These catalysts are activated by presulfurization, which is the same method used to activate the naphtha desulfurization catalysts. The activation treatment generally comprises mixing naphtha with a sulfur compound, e.g., dimethyl disulfide, heating the mixture to 150° to 350° C. together with hydrogen, and passing the heated mixture through a reactor packed with the catalyst. The sulfur compound, e.g., dimethyl disulfide, reacts with hydrogen on the surface of the active metals contained in the catalyst to convert the same into hydrogen sulfide, which further reacts with the active metals to yield metal sulfides active in the desulfurization reaction.

SUMMARY OF THE INVENTION

An object of the present invention is to provide a process for desulfurizing a catalytically cracked gasoline containing sulfur compounds and olefin components by catalytic hydrodesulfurization. In this process not only is there a small decrease in the octane number of the gasoline because the hydrogenation of olefin components is inhibited, but also high desulfurization activity can be maintained over a long period of time.

The present inventors have conducted extensive studies in order to accomplish the above described objectives. As a result, the present inventors have discovered an exceedingly useful process for hydrodesulfurizing a catalytically cracked gasoline containing sulfur compounds and olefin components in which not only is the hydrogenation reaction of the olefin components inhibited but coke deposition can also be inhibited by conducting the hydrodesulfurization in the vapor phase using specific reaction conditions and a specific catalyst.

The above objects have been achieved by providing a process for desulfurizing a feedstock oil of a catalytically cracked gasoline containing sulfur compounds and olefin components in a reactor having a reactor inlet which comprises hydrodesulfurizing the gasoline under reaction conditions shown in (a) below using a desulfurization catalyst shown in (b) below;

(a) Reaction conditions:

a hydrogen feed rate measured at the reactor inlet of from 1 to 5 mols per mol of the feedstock oil and of from 5 to 50 mols per mol of the olefin components contained in the feedstock oil, a reaction temperature of from 200° to 300° C., a total pressure inside the reactor of from 10 to 20 kg/cm$^2$G, and a liquid hourly space velocity (LHSV) of from 2 to 8 l/hr;

(b) Catalyst:

a catalyst which comprises a support mainly comprising alumina and having a surface area of 200 m$^2$/g or larger, wherein $MoO_3$ in an amount of from 10 to 20 wt % and CoO in an amount of from 3 to 6 wt % in terms of inner content are fixed to the support, and the weight ratio of $MoO_3$ to CoO is from 2.5 to 4.5.

DETAILED DESCRIPTION OF THE INVENTION

Although the desulfurization reactions of various kinds of general petroleum fractions are conducted in various phases (e.g., the vapor phase, liquid phase, and vapor/liquid mixed phase), one of the features of the process of the present invention is that the desulfurization of a feedstock oil is carried out entirely in the vapor phase. The desulfurization reaction is preferably conducted at a low temperature because the desulfurization reaction more readily proceeds at low temperatures as compared to the hydrogenation of olefins. Hence, lower desulfurization temperatures result in smaller decreases in octane number. In liquid-phase desulfurization, the catalyst is contacted with sulfur compounds and hydrogen via a liquid. In contrast, in vapor-phase desulfurization, the catalyst is in direct contact with sulfur compounds and hydrogen, so that the reaction proceeds at a higher rate. Because of this, the vapor-phase desulfurization reaction is advantageous in that the reaction can be carried out at a lower temperature as compared to a liquid-phase reaction. Namely, the desulfurization reaction in the vapor phase can be conducted while inhibiting the hydrogenation of olefins. The liquid-phase reaction is further problematic in that the olefins contained in the feedstock oil which wets the catalyst surface tend to polymerize to cause coke deposits. This results in a considerable decrease in catalytic activity.

It should be noted, however, that since reaction control is difficult due to the extremely high activity of the desulfurization catalyst during the initial stage of use thereof, the desulfurization reaction may be conducted at a lower temperature in the presence of a liquid phase for several days until the catalytic activity stabilizes.

A simple and convenient method for selecting conditions for the vapor-phase reaction is to use commercial process computation software.

Another characteristic feature of the present invention is that the feedstock oil that is contacted with a catalyst is fed together with hydrogen at a hydrogen feed rate such that the hydrogen amount measured at the reactor inlet is at least 1 mol and preferably from 1 to 5 mols per mol of the feedstock oil, and from 5 to 50 mols per mol of olefin components contained in the feedstock oil. The use of such a large molar proportion of hydrogen is effective not only in preventing the generation of coke which deteriorates catalytic activity, but also in preventing reaction inhibition by the adsorption of hydrogen sulfide onto active sites due to reduced hydrogen sulfide concentration in the vapor phase. Moreover, the reaction of hydrogen sulfide resulting from desulfurization with olefins to yield thiols can be suppressed, so that a high degree of desulfurization can be attained without hydrogenating the olefins. The necessary amount of hydrogen may be calculated from the average molecular weight of the feedstock oil.

On the other hand, the hydrogenation of olefins is less influenced by the molar proportion of hydrogen than the desulfurization reaction. Consequently, by feeding hydrogen in a large (excess) molar proportion, desulfurization can be carried out while minimizing the decrease in octane number.

When a feedstock oil containing no olefin components, such as, e.g., a naphtha or kerosine, is desulfurized in the vapor phase, hydrogen is used usually in an amount of about from 0.3 to 0.5 mol per mol of the feedstock oil, which amount is far less than the hydrogen amount of from 1 to 5 mols per mol of the feedstock oil as used in the present invention. Furthermore, the total reactor pressure for an olefin-free feedstock oil is 30 kg/cm$^2$G, which is higher than the total pressure of from 10 to 20 kg/cm$^2$G that is used in the present invention.

The reaction conditions of the present invention, which are optimum conditions selected based on the mechanism found by the present inventors concerning the desulfurization of catalytically cracked gasolines, are fundamentally different from conventional reaction conditions for the desulfurization of naphtha fractions.

Various apparatus are used for the partial hydrogenation of thermally cracked gasolines containing olefins. Such apparatus have not been designed for desulfurization, but rather for selective hydrogenation of dienes that are present in small amounts. Thus, hydrogen is fed to such apparatus in an amount as small as about 0.5 mol per mol of the feedstock oil. Therefore, the process of the present invention, in which hydrogen is used in an amount of from 1 to 5 mols per mols of the feedstock, employs entirely different conditions based on investigations of the desulfurization of catalytically cracked gasolines.

Other important reaction conditions in the present invention include a reaction temperature of from 200° to 300° C., a total pressure inside the reactor of from 10 to 20 kg/cm$^2$G, and a liquid hourly space velocity (LHSV) of from 2 to 8 l/hr. Although lower reaction temperatures are advantageous from the standpoint of inhibiting olefin hydrogenation, temperatures lower than 200° C. are impractical because this results in reduced desulfurization activity. Temperatures higher than 300° C. are undesirable in that the olefin hydrogenation reaction proceeds, resulting in a reduced octane number.

The total pressure inside the reactor is preferably 20 kg/cm$^2$G or lower from the standpoint of inhibiting olefin hydrogenation. Total pressures lower than 10 kg/cm$^2$G are impractical because of the need for a larger apparatus and are also disadvantageous in that the catalytic deteriorates considerably deteriorates due to coke deposition.

The liquid hourly space velocity (LHSV) is from 2 to 8 l/hr because desulfurization can be carried out efficiently at these rates. LHSV's lower than 2 l/hr are undesirable in that an increased amount of the catalyst is needed, whereas LHSV's higher than 8 l/hr are undesirable in that the frequency of catalyst exchange is increased.

Although the reaction tower is not particularly limited, a fixed bed type is preferred. For promoting good contact of the catalytically cracked gasoline, hydrogen and the catalyst with one another, a co-current descending flow-type-reaction tower is generally used.

In the present invention, the catalyst comprises a support mainly comprising alumina and having a surface area of 200 m$^2$/g or larger. $MoO_3$ in an amount of from 10 to 20 wt % and CoO in an amount of from 3 to 6 wt % in terms of inner content are fixed to the support. Also, the weight ratio of $MoO_3$ to CoO being from 2.5 to 4.5. The support preferably contains alumina in an amount of 90 wt % or more. Use of a support having a surface area of 200 m$^2$/g or larger is effective in fixing from 10 to 20 wt % $MoO_3$ and from 3 to 6 wt % CoO thereto while inhibiting metal aggregation, so that a highly active catalyst can be prepared. By setting the $MoO_3$/CoO weight ratio to a value of from 2.5 to 4.5, the hydrogenation of olefins is inhibited and desulfurization can be carried out efficiently. A useful method for fixing the metals to the support is to fix both metals at a time using a pore-filling technique.

When the desulfurization catalyst is such that the amount of $MoO_3$ fixed to the support is not larger than 80% of the amount of $MoO_3$ capable of being dispersed on the support surface in the form of a monomolecular layer, the hydrogenation of olefins can be inhibited more effectively and desulfurization can be carried out more efficiently. According to *Kōgyō Kagaku Zasshi*, Vol. 74, No. 8 (1971), $MoO_3$ is bonded to an alumina surface in the manner shown in FIG. 1 of this literature reference. Since each $O^{2-}$ ion present on the alumina surface occupies 8 Å$^2$ and three $O^{2-}$ ions are bonded to one Mo atom, the amounts Wmo (outer content) and Wmi (inner content) of the $MoO_3$ capable of being dispersed on the support surface in the form of a monomolecular layer are expressed by the following equations, respectively. The amount Wci (inner content) of the CoO is defined as follows.

$$Wmo=(M/No)[S/(8\times10^{-20})](1/3)$$

$$Wmi=Wmo/(Wmo+Wco+1)$$

$$Wci=Wco/(Wmo+Wco+1)$$

M: molecular weight of $MoO_3$ (143.9)

Wmo: amount of fixed $MoO_3$ dispersible in the form of a monomolecular layer, outer content (unit: g-$MoO_3$/g-catalyst support)

Wmi: amount of fixed $MoO_3$ dispersible in the form of a monomolecular layer, inner content (unit: g-$MoO_3$/g-catalyst)

Wco: amount of fixed CoO, outer content (g-CoO/g-catalyst support)

Wci: amount of fixed CoO, inner content (g-CoO/g-catalyst)

No: Avogadro's number ($6.02\times10^{23}$)

S: surface area of the support (unit: m$^2$/g)

If $MoO_3$ has been fixed in an amount exceeding the amount corresponding to a monomolecular layer thereof, the $MoO_3$ which remains unbonded to the alumina aggregates to form aggregate particles. The aggregates are sulfurized to a lesser extent and hence disadvantageously accelerate olefin hydrogenation. Even if $MoO_3$ has been fixed in an amount not larger than the fixed $MoO_3$ amount dispersible in the form of a monomolecular layer, part of the $MoO_3$ can aggregate as a result of baking after fixing to the support. This aggregation is effectively avoided by setting the amount of the fixed $MoO_3$ to a value up to 80% of the amount of $MoO_3$ dispersible in the form of a monomolecular layer on the support.

On the other hand, when CoO is fixed in an amount of from 3 to 6 wt %, it is considered that CoO remains unbonded to the alumina. According to the preprints of the Symposium on Hydrocracking and Hydrotreating by American Chemical Society in Philadelphia Meeting Page 574, FIG. 11 (1975), Co is located on Mo as an ion $Co^{2+}$ and Co does not bond to alumina. The CoO serves to enhance the desulfurization activity of Mo after sulfurization. In this way, only Mo can be dispersible in the form of a monomolecular layer on the support.

When a desulfurization catalyst comprising an alumina support containing from 0.2 to 3.0 wt % potassium and $MoO_3$ and CoO are fixed to the support, the coke deposition caused by olefin polymerization can be minimized and stable desulfurization activity can be maintained over a long period of time.

EXAMPLES

The present invention will be explained in more detail below by reference to the following Examples. However, the present invention should not be construed as being limited thereto.

Example 1

CoO and $MoO_3$ were fixed to a 1/16 inch extruded alumina support (surface area: 264 m$^2$/g) which had been baked at 600° C. and containing 1 wt % potassium by a pore-filling technique in amounts of 4.3 wt % and 15 wt %, respectively, in terms of inner content. The fixed $MoO_3$ amount was 72% of the fixed $MoO_3$ amount dispersible in the form of a monomolecular layer on the support. The support was baked again at 600° C., and 60 ml of the resulting catalyst was packed into a small fixed-bed co-current descending flow-type reactor.

Using JIS No. 1 industrial gasoline to which 5 wt % dimethyl disulfide had been added, presulfurization was conducted for 5 hours under conditions of 300° C., a pressure of 15 kg/cm$^2$G, an LHSV of 2 l/hr, and a hydrogen/oil ratio of 500 scf/bbl.

After lowering the temperature within the reactor to 250° C., a desulfurization reaction test was conducted using a catalytically cracked gasoline (density at 15° C., 0.779 g/cm$^3$; sulfur content, 220 ppm by weight; olefin content 32 vol %; research octane number, 87.1) which was an 80°–220° C. fraction having an average molecular weight of 120 and obtained by catalytically cracking a feedstock containing a topping residue.

The reaction conditions used to conduct the desulfurization were a temperature of 230° C., a reaction pressure of 15 kg/cm$^2$G, an LHSV of 4 l/hr, and a hydrogen/oil ratio of 2,000 scf/bbl. The hydrogen/feedstock oil molar ratio and the hydrogen/olefin molar ratio measured at the reactor inlet were 2.3 and 7.3, respectively.

As a result, a hydrodesulfurized, catalytically cracked gasoline was obtained which had a sulfur content of 60 ppm by weight, an olefin content of 29 vol %, and a research octane number of 85.9.

The amount of coke measured after conducting the reaction for 30 days was 6.8 wt %.

Example 2

Using the same reactor and catalyst as in Example 1, the same presulfurization was conducted as in Example 1. Thereafter, the same catalytically cracked gasoline as in Example 1 was subjected to a desulfurization reaction test.

The reaction conditions used to conduct the desulfurization were a temperature of 250° C., a reaction pressure of 20 kg/cm$^2$G, an LHSV of 7 l/hr, and a hydrogen/oil ratio of 1,500 scf/bbl. The hydrogen/feedstock oil molar ratio and the hydrogen/olefin molar ratio measured at the reactor inlet were 1.9 and 5.4, respectively.

As a result, a hydrodesulfurized, catalytically cracked gasoline was obtained which had a sulfur content of 67 ppm by weight, an olefin content of 28 vol %, and a research octane number of 85.4.

The amount of coke measured after conducting the reaction for 30 days was found 7.0 wt %.

Comparative Example

CoO and $MoO_3$ were fixed to a 1/16 inch extruded alumina support (surface area: 275 m$^2$/g) which had been baked at 600° C. by a pore-filling technique in amounts of 6.0 wt % and 20 wt %, respectively, in terms of inner content. The fixed amount of $MoO_3$ was 92% of the fixed $MoO_3$ amount dispersible in the form of a monomolecular layer.

This catalyst was packed into the same reactor as in Example 1 to conduct the same presulfurization as in Example 1. Thereafter, a desulfurization reaction test was conducted using the same catalytically cracked gasoline as in Example 1.

The reaction conditions used to conduct the desulfurization were a temperature of 250° C., a reaction pressure of 30 $kg/cm^2G$, an LHSV of 5 l/hr and a hydrogen/oil ratio of 500 scf/bbl. The hydrogen/feedstock oil molar ratio and the hydrogen/olefin molar ratio measured at the reactor inlet were 0.6 and 1.8, respectively.

As a result, a hydrodesulfurized, catalytically cracked gasoline was obtained which had a sulfur content of 65 ppm by weight, an olefin content of 24 vol %, and a research octane number of 84.2.

The amount of coke measured after conducting the reaction for 30 days was found 7.9 wt %.

By hydrodesulfurizing a catalytically cracked gasoline in the vapor phase using the specific conditions and the specific catalyst of the present invention, not only is there a small decrease in the octane number of the gasoline because the hydrogenation of olefins is inhibited, but also the desulfurization reaction can continue over a long period of time while maintaining stable high catalytic activity because coke deposition is also inhibited.

While the invention has been described in detail and with reference to specific embodiments thereof, it will be apparent to one skilled in the art that various changes and modification can be made therein without departing from the spirit and scope thereof.

What is claimed is:

1. The process for desulfurizing a feedstock oil of a catalytically cracked gasoline containing sulfur compounds and olefin components in a reactor having a reactor inlet which comprises hydrodesulfurizing the gasoline under reaction conditions shown in (a) below and using a desulfurization catalyst shown in (b) below;

(a) Reaction conditions:

a hydrogen feed rate measured at the reactor inlet of from 1 to 5 mols per mol of the feedstock oil and of from 5 to 50 mols per mol of the olefin components contained in the feedstock oil, a reaction temperature of from 200° to 300° C., a total pressure inside the reactor of from 10 to 20 $kg/cm^2G$, and a liquid hourly space velocity (LHSV) of from 2 to 8 l/hr;

(b) Catalyst:

a catalyst which comprises a support mainly comprising alumina and having a surface area of 200 $m^2/g$ or larger, wherein $MoO_3$ in an amount of from 10 to 20 wt % and CoO in an amount of from 3 to 6 wt % in terms of inner content are fixed to the support, and the weight ratio of $MoO_3$ to the CoO is from 2.5 to 4.5, wherein the amount of $MoO_3$ fixed to the catalyst support is not more than 80% of the amount of $MoO_3$ capable of being dispersed on the surface of the support in the form of a monomolecular layer.

2. The process as claimed in claim 1, wherein the desulfurization catalyst comprises an alumina support containing from 0.2 to 3.0 wt % potassium, and wherein $MoO_3$ and CoO are fixed to the support.

3. The process as claimed in claim 1, wherein said hydrodesulfurizing is carried out entirely in the vapor phase.

4. The process as claimed in claim 1, wherein said hydrodesulfurizing comprises contacting the feedstock oil with the desulfurization catalyst and hydrogen in the vapor phase and in the absence of a liquid phase or a vapor/liquid mixed phase.

* * * * *